US006811093B2

(12) United States Patent
Rado

(10) Patent No.: US 6,811,093 B2
(45) Date of Patent: Nov. 2, 2004

(54) PIEZOELECTRIC ACTUATED FUEL INJECTORS

(75) Inventor: Gordon E. Rado, Brookfield, WI (US)

(73) Assignee: Tecumseh Products Company, Tecumseh, MI (US)

( * ) Notice: Subject to any disclaimer, the term of this patent is extended or adjusted under 35 U.S.C. 154(b) by 0 days.

(21) Appl. No.: 10/430,819

(22) Filed: May 6, 2003

(65) Prior Publication Data

US 2004/0074985 A1 Apr. 22, 2004

Related U.S. Application Data

(60) Provisional application No. 60/419,278, filed on Oct. 17, 2002.

(51) Int. Cl.[7] ..... B05B 1/08

(52) U.S. Cl. ..... 239/102.2; 239/533.3; 239/533.4; 239/584; 251/129.06; 310/328

(58) Field of Search ..... 239/102.2, 451, 239/456, 533.3, 533.4, 584, 533.8; 251/129.06; 310/317, 323.01, 328

(56) References Cited

U.S. PATENT DOCUMENTS

| | | | | |
|---|---|---|---|---|
| 4,101,076 A | | 7/1978 | Bart | |
| 4,535,743 A | | 8/1985 | Igashira et al. | |
| 4,545,561 A | | 10/1985 | Brown | |
| 4,739,929 A | * | 4/1988 | Brandner et al. | 239/102.2 |
| 4,750,706 A | * | 6/1988 | Schlagmuller | 251/129.06 |
| 4,909,440 A | | 3/1990 | Mitsuyasu et al. | |
| 4,927,084 A | | 5/1990 | Brandner et al. | |
| 5,199,641 A | | 4/1993 | Hohm et al. | |
| 5,482,213 A | | 1/1996 | Matsusaka et al. | |
| 5,630,440 A | | 5/1997 | Knutson et al. | |
| 5,632,841 A | | 5/1997 | Hellbaum et al. | |
| 5,779,149 A | | 7/1998 | Hayes, Jr. | |
| 5,803,361 A | * | 9/1998 | Horiuchi et al. | 239/533.8 |
| 5,979,803 A | | 11/1999 | Peters et al. | |
| 6,079,641 A | | 6/2000 | Shinagle et al. | |
| 6,085,990 A | | 7/2000 | Augustin | |
| 6,113,014 A | | 9/2000 | Coldren et al. | |
| 6,142,443 A | | 11/2000 | Potschin et al. | |
| 6,146,102 A | | 11/2000 | Otome et al. | |
| 6,155,500 A | | 12/2000 | Takase | |
| 6,234,404 B1 | | 5/2001 | Cooke | |
| 6,279,842 B1 | | 8/2001 | Spain | |
| 6,293,255 B1 | | 9/2001 | Otome et al. | |
| 6,298,829 B1 | | 10/2001 | Welch et al. | |
| 6,299,074 B1 | | 10/2001 | Cooke | |
| 6,302,333 B1 | | 10/2001 | Hoffmann et al. | |
| 6,302,341 B1 | | 10/2001 | Yoo | |
| 6,315,216 B1 | | 11/2001 | Boecking | |
| 6,318,342 B1 | | 11/2001 | Simon et al. | |
| 6,345,771 B1 | | 2/2002 | Gromek et al. | |
| 6,363,913 B1 | | 4/2002 | Milam et al. | |
| 6,364,221 B1 | | 4/2002 | Czimmek | |
| 6,371,085 B1 | | 4/2002 | Boecking | |
| 6,435,430 B1 | | 8/2002 | Ruehle et al. | |

* cited by examiner

*Primary Examiner*—Steven J. Ganey
(74) *Attorney, Agent, or Firm*—Baker & Daniels

(57) ABSTRACT

A fuel injector including a piezoelectric actuator directly attached to a metering rod wherein when the actuator is distorted in proportion to an input voltage, the metering rod moves to vary the size of a discharge spray orifice. The input voltage, and therefore the distortion of the actuator, may be varied in accordance with the readings from a throttle position sensor or an oxygen sensor, for example. A dual actuator type of fuel injector is also provided which has an injector body in engagement with the combustion chamber and a fuel chamber therein to receive low pressure fuel. A piezoelectric actuator moves a piston to close the fuel chamber inlet and pressurize the fuel therein. A second piezoelectric actuator moves the metering rod to open the discharge orifice. The amount of distortion of the respective actuators effects proportional movement of the piston or the metering rod.

21 Claims, 1 Drawing Sheet

PIEZOELECTRIC ACTUATED FUEL INJECTORS

CROSS-REFERENCE TO RELATED APPLICATION

This application is related to and claims the benefit under 35 U.S.C. §119(e) of U.S. Provisional Patent Application Ser. No. 60/419,278, filed Oct. 17, 2001.

BACKGROUND OF THE INVENTION

1. Field of the Invention

The present invention relates to internal combustion engines, and specifically to fuel injectors for small internal combustion engines.

2. Description of the Related Art

Internal combustion engines have at least one combustion chamber defined therein, each chamber having a spark plug associated therewith. Fuel enters the combustion chamber and is ignited by the spark plug to operate the engine. One method of moving fuel into the combustion chamber is to use fuel injectors which inject a regulated amount of fuel into the chamber to be ignited.

There are several types of fuel injectors used to deliver fuel to the engine's combustion chambers. One type of commonly used fuel injector is a port type fuel injector. Port type fuel injectors are generally classified as one of two types including spray nozzles where the fuel flow is controlled at the fuel pump by fuel pressure, and spray nozzles including a control device such as a solenoid to control the duration of the spray action. Another type of fuel injector is a direct type fuel injector which provides injection of fuel directly into the compression chamber. This type of fuel injector has two actuators, one for controlling a metering rod or needle, and one for controlling the volume and pressure of a fuel chamber defined in the injector adjacent the discharge orifice.

Although fuel injectors have become an increasingly common component of internal combustion engines, particularly those used in automobiles, the actuation of fuel injectors used in small engines can be problematic. Previous actuation methods for fuel injectors have included the use of solenoids to control the injection of the fuel into the combustion chamber. However, such solenoids generally allow for only a single injection rate of fuel, and thus would be unable to adjust the amount of fuel being injected to correspond to different applications or environments of the engine.

Other actuation methods have included the use of certain piezoelectric devices. In U.S. Pat. No. 6,435,430 (Ruehle et al.), the piezoelectric actuator is used to actuate a fuel injector. The actuator is mounted to a base plate to which a needle is attached. As the actuator expands, the base plate is forced upwardly thus causing the needle to unseat from the discharge port. A compression spring is located between the base plate and fuel inlet connection piece of the fuel injector housing to return the needle to its seated position. Although Ruehle et al. uses a piezoelectric actuator to operate the fuel injector, the assembly of the fuel injector is complicated requiring several components. Further, a spring is required to return the needle to its closed position.

A fuel injector which would be simple, inexpensive, and accurate for the operating conditions of the engine is desirable.

SUMMARY OF THE INVENTION

The present invention relates to fuel injectors for use with small internal combustion engines. A first embodiment provides a port type fuel injector having a metering rod for controlling the flow of fuel through a spray orifice in the body of the fuel injector. A piezoelectric actuator is attached directly to the metering rod and the piezoelectric actuator and metering rod assembly is mounted to the fuel injector body by a vented retaining or end cap. When the piezoelectric actuator is distorted in proportion to an input voltage, the actuator moves the metering needle to open the spray orifice. The input voltage, and subsequently the distortion of the actuator, may be varied in accordance with the readings from a throttle position sensor, or an oxygen sensor, for example.

A second embodiment of the present invention uses piezoelectric actuators in a dual actuator, or direct, type fuel injector. The direct type fuel injector has a injector body in communication with the combustion chamber and which receives low pressure fuel into a fuel chamber thereof. A piezoelectric actuator is used to move a piston that defines with the fuel injector body a fuel chamber. The piston is moved by the actuator to close the fuel chamber inlet and pressurize the fuel located in the chamber. A second piezoelectric actuator is directly connected to the metering needle to facilitate movement thereof. The fuel injection is then controlled by both the duration that the inlet port is open and distance the metering needle is lifted from its seat.

One advantage of the fuel injectors of the present invention is that the piezoelectric actuators are mounted directly to the metering needle or piston which allows for accuracy when delivering fuel to the combustion chamber. Further, the piezoelectric actuators are mounted in the fuel injectors by the end caps thereof, simplifying assembly and reducing the cost of the fuel injector.

One form of the present invention provides a fuel injector having a fuel injector body defining a fuel chamber therein. The fuel injector body includes at least one inlet in communication with the fuel chamber and has a retaining cap secured thereto. At least one outlet is defined in the fuel injector body. At least one control member is in the fuel chamber selectively variably engaging the outlet to cause the outlet to be in one of a range of conditions from fully open to fully closed. At least one piezoelectric actuator is directly connected to the control member. The actuator is secured to the injector body by the retaining cap and is distorted when an external voltage is applied thereto. When the actuator is distorted, the control member is moved, selectively changing the condition of the outlet.

In another form of the present invention the fuel injector body includes at least one inlet in communication with the fuel chamber. At least one outlet is defined in the fuel injector body. At least one control member is in the fuel chamber selectively variably engaging the outlet to cause the outlet to be in one of a range of conditions from fully open to fully closed. A piston is mounted in the injector body in surrounding relationship of the control member. A first piezoelectric actuator is directly connected to the control member and a second piezoelectric actuator is directly connected to the piston. The actuator is distorted when an external voltage is applied thereto which moves the control member and selectively changes the condition of the outlet.

BRIEF DESCRIPTION OF THE DRAWINGS

The above-mentioned and other features and objects of this invention will become more apparent and the invention itself will be better understood by reference to the following description of embodiments of the invention taken in conjunction with the accompanying drawings, wherein.

Figure 1:
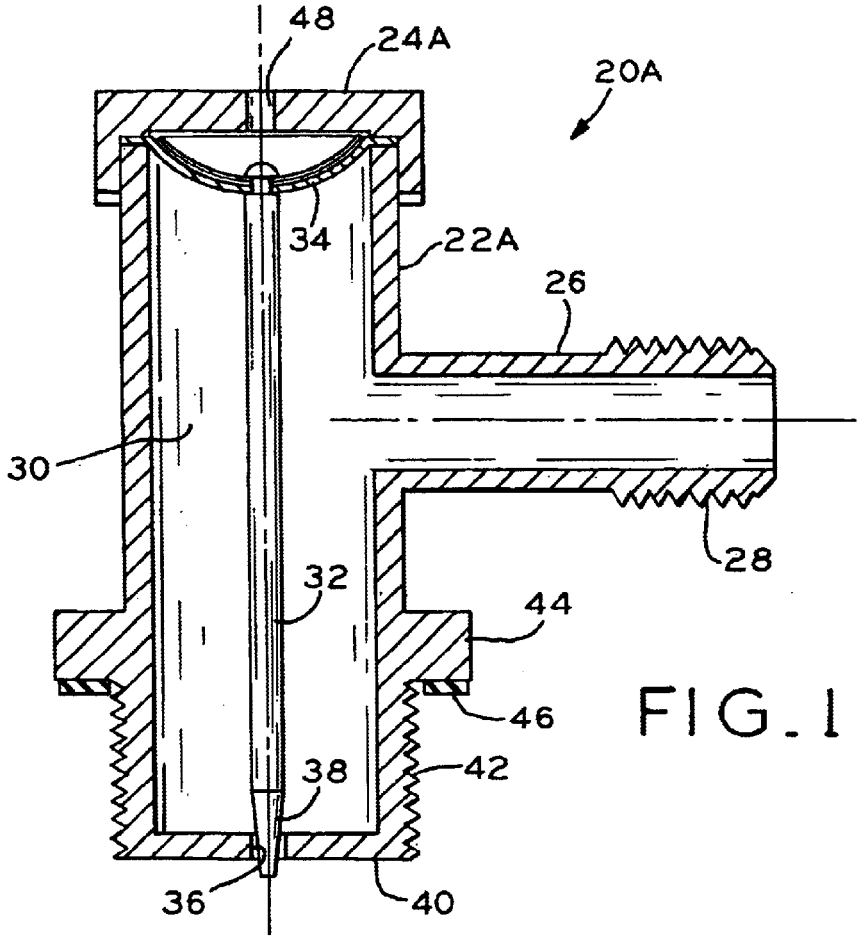
FIG. 1 is a sectional view of a port type fuel injector in accordance with one embodiment of the present invention.

Corresponding reference characters indicate corresponding parts throughout the two views. Although the drawings represent two embodiments of the present invention, the drawings are not necessarily to scale and certain features may be exaggerated in order to better illustrate and explain the present invention. The exemplifications set out herein illustrate embodiments of the invention and such exemplifications are not to be construed as limiting the scope of the invention in any manner.

DETAILED DESCRIPTION

Figure 2:
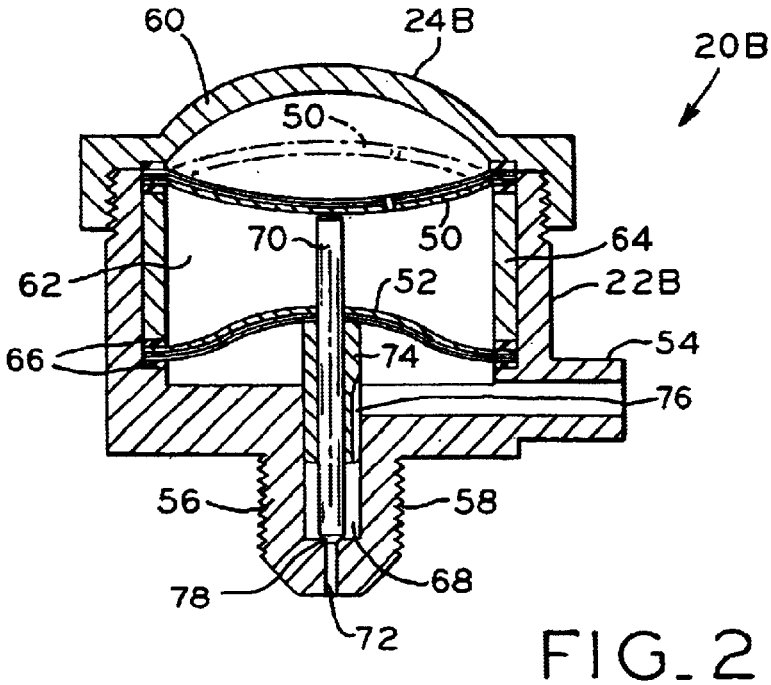
FIG. 2 is a sectional view of dual actuator type fuel injector in accordance with a second embodiment of the present invention.

With reference to FIGS. 1 and 2, fuel injectors 20A and 20B are shown with each injector having injector body 22A and 22B, and retaining caps 24A and 24B respectively mounted to bodies 22A and 22B. Cap 24B is shown as being threadedly secured to injector body 22B. However, any suitable method providing a sealed engagement between the end cap and injector body may be used to assemble the fuel injector housing.

Referring now to FIG. 1, fuel injector 20A of the first embodiment includes fuel line connection or inlet 26 integrally formed with and extending from body 22A. Fuel inlet 26 has threads 28 formed near the end thereof to provide a sealing connection with a fuel line (not shown) through which pressurized fuel from the fuel pump (not shown) of the engine (not shown) enters injector 20A. The pressurized fuel entering injector body 22A is received in chamber 30 defined therein in which a control member in the form of metering rod or needle 32 is located. Metering needle 32 is directly attached to piezoelectric actuator 34 at a top end thereof with needle 32 extending substantially perpendicularly from actuator 34. The lower end of needle 32 is partially seated within discharge opening or orifice 36 formed in the lower end of injector body 22A. Metering needle 32 includes tapered end 38 which, in conjunction with discharge orifice 36, restricts the clearance between needle 32 and orifice 36 to control the flow of pressurized fuel from chamber 30.

Piezoelectric actuator 34 may be disk-shaped with circumferential edge 39 being sandwiched between retaining cap 24A and injector body 22A to mount the actuator and needle assembly within the injector. Retaining cap 24A also includes vent hole 48 defined in the center thereof to vent fluid such as air or fuel vapors from the space above piezoelectric actuator 34 as it is actuated. Alternatively, vent hole 48 may be eliminated and the piezoelectric disk 34 provided with a vent hole (not shown) therein. Furthermore, the piezoelectric actuator 34 could be rectangular-shaped, thereby providing greater displacement when actuated and eliminating the need for vent hole.

Piezoelectric actuator 34 may be of the type produced by Face International, under the "Thunder" trademark, such as disclosed in U.S. Pat. No. 5,632,841 (Hellbaum et al.), the complete disclosure of which is expressly incorporated herein by reference.

Piezoelectric actuator 34 is a composite in which individual materials are layered, wherein the bottom layer is stainless steel, the middle layer PZT ceramic, and the top layer aluminum. The layers are bonded to each other by means of an adhesive applied therebetween. As the laminate is autoclaved during processing, the laminate is heated and compressed, allowed to cook and then cooled to room temperature. During cooling, the mismatch in coefficients of thermal expansion cause the material and ceramic layers to contract at different rates thereby putting the ceramic in compression at room temperature. This results in a pre-stress internal to the individual layers which provides the characteristic curvature of the device.

The pre-stress keeps the ceramic in compression and allows the device 34 to be deflected far more than standard piezoceramics without cracking. When a voltage is applied, the radius of curvature will either increase or decrease, depending on the polarity, thereby creating a pumping motion with relatively large displacements. The design of piezoelectric actuator 34 provides a rapid response time and large displacement of needle 32.

Lower end 40 of injector body 22A includes threads 42 formed thereon for sealed connection to the head or combustion chamber of the engine. Flange 44 is integrally formed on injector body 22A and is located immediately above threads 42. Annular gasket 46 is seated against flange 44 to provide a seal between the injector 20A and the engine.

The operation of injector 20A is based upon the distortion in piezoelectric actuator 34 induced by application of an input voltage to actuator 34. Piezoelectric actuator 34 acts as a positioning device for metering needle 32 in that the greater the distortion of actuator 34, the greater distance metering needle 32 is moved upwardly within fuel chamber 30. As needle 32 moves, tapered end 38 moves away from its seated position to increase the clearance between orifice 36 and needle 32, and thereby control the flow of fuel through discharge orifice 36. The distortion of actuator 34 is directly proportional to the input voltage applied thereto, with the input voltage being determined by feedback received from sensors in other portions of the engine, such as a throttle position sensor (not shown) or an oxygen sensor (not shown). Such sensors provide a signal relaying the amount of oxygen in the fuel-air mixture, or the position of the throttle to allow the engine to demand a certain amount of fuel be injected. Actuator 34 may be controlled by an external microprocessor which meters the amount of fuel needed in the combustion chamber.

Referring now to FIG. 2, injector 20B of the second embodiment includes two piezoelectric actuators 50 and 52. Injectors 50 and 52 are structurally similar to actuator 34 of embodiment 20A, specifically being either disk-shaped or strip-shaped and capable of distorting responsive to an input voltage. To show such distortion, actuator 50 is also shown in phantom in its uppermost position within valve body 22B. Piezoelectric actuators 50 and 52 may be of the type produced by Face International, under the "Thunder" trademark or of the type disclosed in U.S. Pat. No. 5,632,841, the complete disclosure of which is expressly incorporated herein by reference.

As described above, cap 24B is threadedly secured to valve body 22B. Valve body 22B includes low pressure fuel inlet 54 extending therefrom, and which has no threads, unlike the fuel line connection 26 of first embodiment injector 20A. Inlet 54 may be secured to the fuel line by any suitable means including an interference fit, adhesive, or the like. Lower extending portion 56 having thread 58 thereon extends from the lower end surface of injector body 22B for threaded engagement with the head or combustion chamber of the internal combustion engine. Retaining cap 24B has rounded portion 60 thereon to accommodate the upward distortion of piezoelectric actuator 50.

Body 22B defines chamber 62 between actuators 50 and 52 with spacer 64 being placed between actuators 50 and 52 to maintain a desired distance therebetween. Pairs of annular o-rings 66 are located along the circumferential edge of each actuator 50 and 52. With retaining cap 24B threadedly secured to injector body 22B, the circumferential edges of each actuator 50 and 52, spacer 64, and o-rings 66 are sandwiched between the retaining cap and injector body to mount the actuators in the fuel injector. Defined within lower portion 56 of injector body 22B is fuel chamber 68 having a control member in the form of metering rod or needle 70 directly connected to actuator 50, extending through actuator 52 and into chamber 68. Nozzle or orifice 72 is located at the lower end of extending portion 56 and is in fluid communication with chamber 68. Fuel flows through nozzle 72 into the head or combustion chamber of the engine. Piston 74 is located in injector body 22B in surrounding relation of a portion of metering rod 70 and is directly attached to actuator 52. Piston 74 has slot 76 formed therein which may be in fluid communication with inlet 54 depending upon the position of piston 74 within fuel chamber 68.

To operate injector 20B, fuel flows into low pressure inlet 54, past piston 74 via slot 76, and into fuel chamber 68. The amount of fuel within chamber 68 is varied by the movement of piston 74, or by the amount of time that the inlet port is opened, i.e., the time that slot 76 is in communication with inlet 54. To vary the length of time, or to move piston 74, a voltage is applied to actuator 52 to cause downward distortion thereof, thereby moving piston 74 further into chamber 68 and moving slot 76 out of fluid communication with inlet 54. Further downward movement of piston 74 pressurizes the fuel in chamber 68.

The fuel within chamber 68 is injected into the combustion chamber of the cylinder head by upward movement of rod 70, and thus movement of tapered needle end 78 relative to orifice 72. To open nozzle 72, a voltage is applied to actuator 50 to cause upward distortion thereof, thereby lifting rod 70 from its seated position in nozzle 72 and allowing the pressurized fuel in chamber 68 to flow into the combustion chamber.

The injection rate can be controlled by the movement of metering rod 70 including the amount of displacement of metering rod 70 from its seated position, and the rate of travel of piston 74 as controlled by actuator 52. Both actuators 50 and 52 may be controlled by an external microprocessor which meters the amount of fuel needed in the combustion chamber.

While this invention has been described as having exemplary structures, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A fuel injector, comprising:

a fuel injector body defining a fuel chamber therein, said fuel injector body including at least one inlet in communication with said fuel chamber;

a retaining cap secured to said fuel injector body;

at least one outlet defined in said fuel injector body;

at least one control member in said fuel chamber, said control member selectively variably engaging said outlet to cause said outlet to be in one of a range of conditions from fully open to fully closed; and at least one piezoelectric actuator directly connected to said control member, said piezoelectric actuator secured to said injector body by said retaining cap, said actuator distorted when an external voltage is applied thereto, and wherein when said actuator is distorted, said control member is moved, selectively changing said condition of said outlet.

2. The fuel injector of claim 1 wherein said control member is a metering rod.

3. The fuel injector of claim 2 wherein said metering rod further includes a tapered end, said tapered end seated in said at least one outlet.

4. The fuel injector of claim 1 wherein said piezoelectric actuator is curved, said control member extending substantially perpendicularly to said actuator.

5. The fuel injector of claim 1 wherein said retaining cap further includes a vent aperture therein.

6. The fuel injector of claim 1 further comprising a piston mounted in surrounding relationship of said control member, said piston defining an opening in communication with said fuel chamber and in selective communication with said inlet.

7. The fuel injector of claim 6 wherein said at least one piezoelectric actuator comprises two piezoelectric actuators, a first said actuator operatively connected to said control member and a second said actuator operatively connected to said piston.

8. The fuel injector of claim 7 wherein when said second actuator is distorted, fuel enters said fuel chamber.

9. The fuel injector of claim 1 wherein each said piezoelectric actuator is arcuate and comprises a piezoelectric ceramic layer that is in compression at room temperature.

10. A fuel injector, comprising:

a fuel injector body defining a fuel chamber therein, said fuel injector body including at least one inlet in communication with said fuel chamber;

a retaining cap secured to said fuel injector body, said retaining cap having a vent aperture formed therein;

at least one outlet defined in said fuel injector body;

at least one control member in said fuel chamber, said control member selectively variably engaging said outlet to cause said outlet to be in one of a range of conditions from fully open to fully closed; and at least one piezoelectric actuator directly connected to said control member, said piezoelectric actuator secured to said injector body by said retaining cap, said control member extending substantially perpendicularly to said actuator, said actuator distorted when an external voltage is applied thereto, and wherein when said actuator is distorted, said control member is moved, selectively changing said condition of said outlet.

11. The fuel injector of claim 10 wherein said control member is a metering rod.

12. The fuel injector of claim 11 wherein said metering rod further includes a tapered end, said tapered end seated in said at least one outlet.

13. The fuel injector of claim 10 wherein each said piezoelectric actuator is arcuate and comprises a piezoelectric ceramic layer that is in compression at room temperature.

14. A fuel injector, comprising:

a fuel injector body defining a fuel chamber therein, said fuel injector body including at least one inlet in communication with said fuel chamber;

at least one outlet defined in said fuel injector body;

at least one control member in said fuel chamber, said control member selectively variably engaging said outlet to cause said outlet to be in one of a range of conditions from fully open to fully closed;

a piston mounted in said injector body, said piston in surrounding relationship of said control member; and a first and second piezoelectric actuator, said first actuator connected to said control member, said second actuator connected to said piston, said actuators distorted when an external voltage is applied thereto, and wherein when said first actuator is distorted, said control member is moved, selectively changing said condition of said outlet.

15. The fuel injector of claim 14 wherein said control member is a metering rod.

16. The fuel injector of claim 15 wherein said metering rod further includes a tapered end, said tapered end seated in said at least one outlet.

17. The fuel injector of claim 14 wherein said first and second piezoelectric actuators are curved, said control member extending substantially perpendicularly to said actuators.

18. The fuel injector of claim 14 wherein said piston further includes an opening in communication with said fuel chamber in selective communication with said inlet.

19. The fuel injector of claim 18 wherein when said second actuator is distorted, fuel enters said fuel chamber.

20. The fuel injector of claim 14 further comprising an annular spacer located between said first and second actuators.

21. The fuel injector of claim 14 wherein each said piezoelectric actuator is arcuate and comprises a piezoelectric ceramic layer that is in compression at room temperature.

* * * * *